United States Patent [19]

Starrett

[11] 3,944,226

[45] Mar. 16, 1976

[54] POLICE CLUB

[75] Inventor: Paul D. Starrett, Rindge, N.H.

[73] Assignee: Monadnock Lifetime Products, Inc., Fitzwilliam, N.H.

[22] Filed: Nov. 21, 1973

[21] Appl. No.: 418,032

[52] U.S. Cl. ..... 273/84

[51] Int. Cl.[2] ..... F41B 15/02

[58] Field of Search ..... 273/67 R, 72 R, 73 J, 75, 273/81 R, 81 D, 82 R, 82 A, 82 B, 84, 165; 145/61 R; 74/551.8, 551.9, 552, 553, 557

[56] References Cited

UNITED STATES PATENTS

| | | | |
|---|---|---|---|
| 146,431 | 1/1874 | Clark et al. | 273/84 X |
| 291,242 | 1/1884 | Tower | 273/84 |
| 377,686 | 2/1888 | Moose | 273/72 R |
| 748,000 | 12/1903 | Murnane | 273/72 R |
| 897,201 | 8/1908 | Gannon | 273/84 |
| 1,078,223 | 11/1913 | Suss | 273/82 R |
| 1,206,095 | 11/1916 | Coy | 273/84 UX |
| 1,569,340 | 1/1926 | Vaile | 273/165 |
| 2,121,989 | 6/1938 | Schnase et al. | 273/84 X |
| 2,199,310 | 4/1940 | Hartley | 273/82 R |
| 3,137,194 | 6/1964 | Simpson | 273/165 UX |
| 3,172,439 | 3/1965 | Fischer | 145/61 R |
| 3,362,711 | 1/1968 | Larsen et al. | 273/84 |
| 3,510,130 | 5/1970 | Ferdinand | 273/72 R UX |
| 3,756,467 | 9/1973 | Anketell | 273/84 X |

FOREIGN PATENTS OR APPLICATIONS

| | | | |
|---|---|---|---|
| 1,287,775 | 2/1962 | France | 273/84 |
| 683,567 | 3/1964 | Canada | 273/82 R |

*Primary Examiner*—Richard J. Apley
*Attorney, Agent, or Firm*—Robert T. Gammons

[57] ABSTRACT

A police club having at the base of the handle grip a radially protruding circumferential shoulder for suspending the club in the carrying ring of an officer's belt for preventing objects sliding down the club from hitting the officer's hand and for preventing the club from slipping in the officer's hand when jabbing.

1 Claim, 5 Drawing Figures

POLICE CLUB

BACKGROUND OF INVENTION

The conventional police club is a smooth polished cylindrical stick with a knurled hand grip at one end and is provided with a leather carrying thong which is attached at the base of the hand grip by a wrap around sling or stirrup. A carrying ring fastened to the officer's belt is provided for receiving the stick when not being held in the hand and the wrap around is relied upon to hold the stick suspended in the ring; hence, if the sling is not secure the club may slip through the ring. Moreover, since the club is of substantially uniform diameter from end to end there is no means for protecting the officer's hand from an object sliding down the club from hitting the officer's hand, nor is there any means to prevent the officer's hand from slipping along the club, except for the knurling when employed in jabbing techniques. It is the purpose of this invention to provide an improved club providing means which will insure suspension in the carrying ring, which will provide a hand guard and which will enable delivering the maximum trust in use.

SUMMARY

A police club comprising an elongate stick of circular cross section, a hand grip at one end and an annular radially protruding shoulder at the base of the hand grip by means of which the club may be suspended in a carrying ring secured to the officer's belt. A flexible carrying thong is wrapped about the base of the hand grip above the shoulder. The shoulder is constituted by an annular ring set into an annular groove at the base of the hand grip. The ring has an outside diameter greater than that of the stick and an inside diameter less than that of the stick and maybe an endless band comprised of expandable material which may be expanded over the larger diameter of the club and slid therealong into the groove or split band which may be expanded over the larger diameter of the club and slid along into the groove. The groove is of substantially rectangular cross section and has spaced parallel side walls which are perpendicular to the axis of the stick and the band has flat spaced parallel annular surfaces the distance between which corresponds to the distance between walls of the grooves so that the band fits snugly into the groove. The stick is comprised of a high impact extruded polymeric material, such as polystyrene and the band may be comprised of the same or different material, as for example, metal.

The invention will now be described in greated detail with reference to the accompanying drawings wherein.

Figure 1:
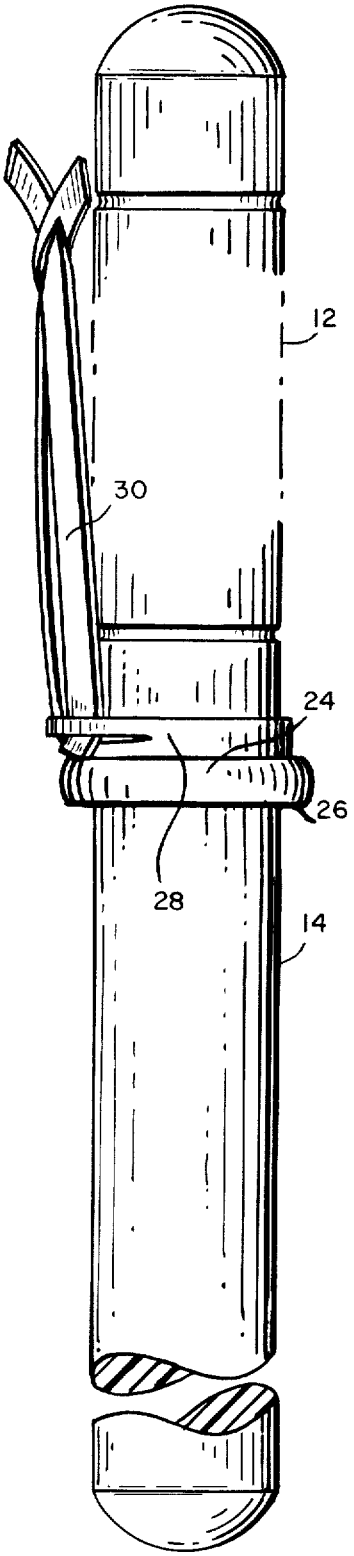
FIG. 1 is a plan view of a police club broken away in part showing the hand grip portion, a thong with a sling disposed about the base of the hand grip and the band for preventing the club from slipping through the belt carrying ring.
Figure 2:
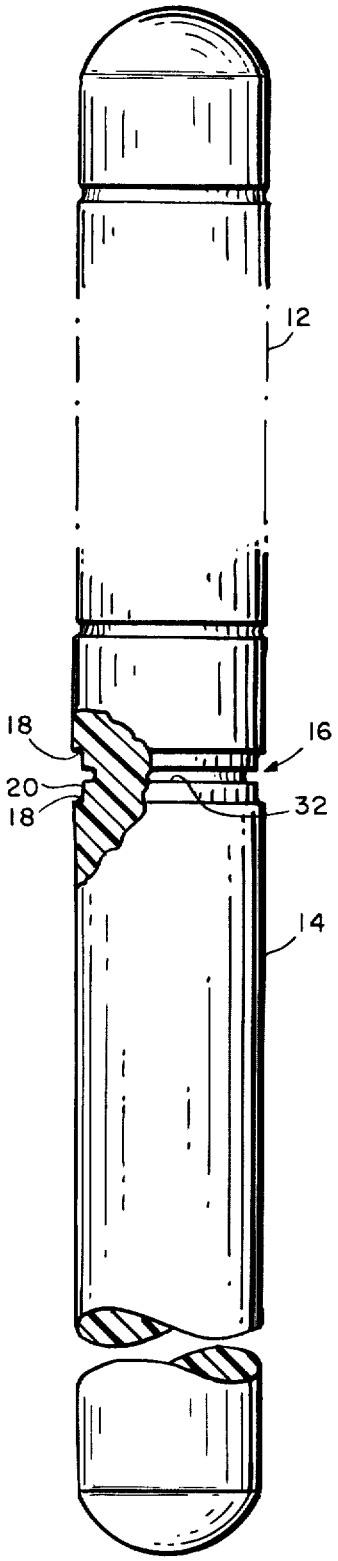
FIG. 2 is a view similar to FIG. 1 with a portion in section, with the thong removed and the band ommited.

Referring to the drawings the police club comprises an elongate stick (10) of circular cross section having a hand grip portion (12) and a club portion (14). At the base of the hand grip portion (12) there is an annular groove (16) of substantially rectangular cross section having spaced parallel radially extending side walls (18—18) and a bottom wall (20).

A band (24) of elastically extendable material is sprung into the groove (16). This band has a diameter which is greater than the diameter of the club so that when sprung into the groove it forms all the way around the stick a radially protruding shoulder (26) by means of which the club may be carried suspended in a carrying ring fastened to the officer's belt. A carrying thong (30) is secured to the club at the base of the hand grip above the band (24) by a wrap around sling (28).

Figure 3:
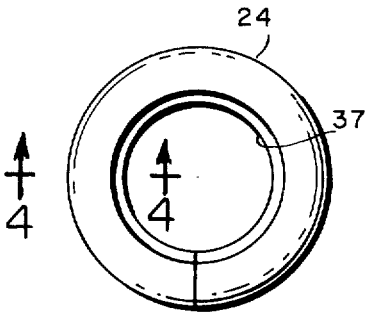
FIG. 3 is a plan view of a split band.
Figure 4:
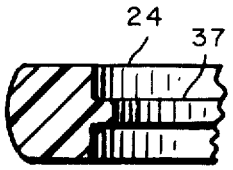
FIG. 4 is a fragmentary section of the split band taken on the line 4—4 in FIG. 3.
Figure 5:
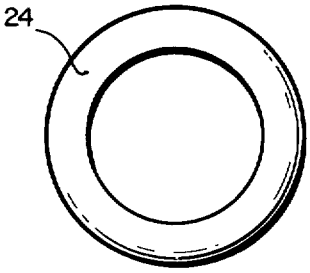
FIG. 5 is a fragmentary plan view of an endless band.

The band (24) has an inside diameter which is less than the diameter of the stick. In one form the band is endless, FIG. 5, and is comprised of material sufficiently elastic to enable it to be expanded over the larger diameter of the stick and to be slid therealong into the groove. Alternatively, the band may be split, FIGS. 3 and 4 so that it may be expanded over the larger diameter of the stick and slid therealong into the groove. The axial thickness of the band corresponds substantially to the width of the groove and it has spaced parallel annular faces which are perpendicular to its axis for snugly fitting into the groove. The outer side of the band is arcuate to provide a smooth surface and its edges are rounded.

When employing a split band the bottom of the groove (16) may contain an annular kerf (32) and the inner side of the band a rib (37) for seating in the kerf. When employing an endless band the kerf (32) at the bottom of the groove (20) at the rib (37) at the inner side of the band (24) are omitted.

The club is made of a high impact extruded polymeric such as polystyrene and has a smooth glossy surface which is especially slick and slippery and so it is especially necessary to provide a band to prevent the sling from slipping off the hand grip and the club in turn slipping through the carrying ring on the belt. The band may be made of a polymeric material which provides the elasticity necessary to hold it locked in the groove or of a suitable metal, and should be tough and hard enough to withstand a heavy blow and to provide a hand guard. The stick as previously mentioned is extruded by a special process which insures that it is free of any voids which might cause it to break or shatter and in order to preserve its integrity the bottoms of the groove and the kerf are filletted so as not to be the starting source of cracks. The mating sides of the band and rib are correspondingly rounded.

It should be understood that the present disclosures are for the purpose of illustration only and that this invention includes all modifications and equivalents falling within the scope of the appended claim.

I claim:

1. A combination of a police club, abutment ring and carrying thong, wherein the club comprises an elongate stick of extruded high impact polymer having a uniformly continuous circular cross section with a hand grip portion at one end, said stick having at the base of the hang grip portion annular grooves of two widths and two diameters, the first groove being axially wider than the second and the second groove radially deeper than the first and arranged symmetrically at the bottom of the first, said first and second grooves having a flat bottom wall and parallel radially extending side walls, said abutment ring being comprised of high impact elastically extendable polymer mounted on the club in engagement with the grooves, said ring having portions of lesser and greater diameter than the diameter of the stick, said portion of lesser diameter being of a width, depth and of a corresponding configuration to fit into said first groove and having an inwardly extending rib of a width, depth and of a corresponding configuration to fit into said second groove, said portions of lesser diameter and rib locking the ring to the club against movement longitudinally thereon at the base of the handle and said part of greater diameter projecting from the surface of the stick and having right angularly disposed flat annular circular surfaces providing radially extending shoulders and said thong being mounted to the club at the base of the handle portion at the proximal side of the ring with respect to the handle portion and embodying an annular loop constricted about the club at the base of the handle with an edge in engagement with the shoulder at that side and being of lesser thickness than the radial width of the shoulder.

* * * * *